US007484373B2

(12) United States Patent
Bucceri

(10) Patent No.: US 7,484,373 B2
(45) Date of Patent: Feb. 3, 2009

(54) SNOW MAKING METHOD AND APPARATUS

(75) Inventor: Alfio Bucceri, Ascot (AU)

(73) Assignee: Snow Factories SA, Brussels (BE)

( * ) Notice: Subject to any disclaimer, the term of this patent is extended or adjusted under 35 U.S.C. 154(b) by 308 days.

(21) Appl. No.: 10/580,927

(22) PCT Filed: Nov. 25, 2004

(86) PCT No.: PCT/AU2004/001647

§ 371 (c)(1),
(2), (4) Date: May 30, 2006

(87) PCT Pub. No.: WO2005/052473

PCT Pub. Date: Jun. 9, 2005

(65) Prior Publication Data

US 2007/0119209 A1 May 31, 2007

(30) Foreign Application Priority Data

Nov. 28, 2003 (AU) ..... 2003906634

(51) Int. Cl.
*F25C 5/06* (2006.01)

(52) U.S. Cl. ..... 62/72; 62/74; 62/347

(58) Field of Classification Search ..... 62/373, 62/66–74, 340–356
See application file for complete search history.

(56) References Cited

U.S. PATENT DOCUMENTS 2,613,511 A * 10/1952 Walsh ..... 62/72
2,683,359 A * 7/1954 Green, Jr. ..... 62/68
2,706,385 A 4/1955 Topping
2,969,650 A 1/1961 Eschenburg et al.
3,052,557 A * 9/1962 Vidal et al. ..... 426/522
3,319,436 A 5/1967 Wilch
3,404,543 A * 10/1968 Diblick ..... 62/344
3,567,177 A 3/1971 Eustis
3,675,988 A 7/1972 Soref
3,733,029 A 5/1973 Eustis et al.

(Continued)

FOREIGN PATENT DOCUMENTS

WO WO 99/56067 11/1999

(Continued)

*Primary Examiner*—William E Tapolcai
(74) *Attorney, Agent, or Firm*—Workman Nydegger

(57) ABSTRACT

An apparatus (10) for making snow or a snow-like substance includes a container (12) having a cooling space (13) adapted to contain pressurized air or gas of above atmospheric pressure. At least one flexible walled vessel (14) extends through the cooling space (13) and is connectable to a water source. The apparatus (10) is operable to maintain the cooling space at a sufficiently low temperature to at least partially freeze the water within the flexible walled vessel (14). As a preferred feature of the snow making apparatus, the apparatus may be adapted to maintain a static pressure within the cooling space of the container (12) and to periodically and temporarily increase the pressure within the cooling space to compress the flexible walled vessel (14). Invention also resides in an apparatus (10) for making snow or a snow-like substance, the apparatus including at least one flexible walled vessel (14) connectable to a water source. Spray equipment (18) sprays heat transfer medium onto the at least one flexible walled vessel (14) to chill the vessel sufficient to form ice crystals and/or snow within the vessel.

21 Claims, 10 Drawing Sheets

U.S. PATENT DOCUMENTS

| | | | | | |
|---|---|---|---|---|---|
| 4,107,937 | A | * | 8/1978 | Chmiel | 435/1.3 |
| 4,276,750 | A | | 7/1981 | Kawasumi | |
| 4,793,142 | A | | 12/1988 | Bucceri | |
| 5,289,973 | A | | 3/1994 | French | |
| 5,297,731 | A | * | 3/1994 | Bucceri | 239/14.2 |
| 5,413,249 | A | | 5/1995 | Chigira | |
| 5,501,367 | A | | 3/1996 | Chigira | |
| 5,660,935 | A | | 8/1997 | Kambayashi et al. | |
| 5,753,370 | A | | 5/1998 | Kambayashi et al. | |
| 5,785,581 | A | | 7/1998 | Settles | |
| 5,964,100 | A | * | 10/1999 | Wisniewski | 62/373 |
| 6,093,312 | A | | 7/2000 | Boulter | |
| 6,112,539 | A | | 9/2000 | Colberg | |
| 6,230,021 | B1 | | 5/2001 | Ohdachi | |
| 6,938,830 | B2 | | 9/2005 | Bucceri | |
| 2005/0035210 | A1 | | 2/2005 | Bucceri | |

FOREIGN PATENT DOCUMENTS

| | | |
|---|---|---|
| WO | WO 02/37039 | 5/2002 |
| WO | WO 02/086401 A1 | 10/2002 |

* cited by examiner

SNOW MAKING METHOD AND APPARATUS

FIELD OF THE INVENTION

The present invention relates to an apparatus and a method for making snow or a snow-like substance. In particular, although not exclusively, the invention relates to a type of snow making apparatus, where snow is made within flexible-walled tubes by fluid transfer from a cooling medium surrounding the tubes.

BACKGROUND OF THE INVENTION

International Patent Application WO 02/37039 describes a snow making method and apparatus utilising a tank which is filled with liquid coolant. A number of flexible hoses are disposed within the tank. The hoses are filled with water and, through the process of heat transfer from the coolant, ice crystals form within the hoses. The hoses are periodically inflated to aid in dislodging the snow or ice crystals from the inner wall surfaces of the hoses. After each inflation, the hoses are permitted to deflate and this is aided by the pressure of the coolant in the tank.

One difficulty with this arrangement is that while snow and/or ice crystals are intended to form on the inner walls of the hoses, there is a risk that the ice crystals can form a solid block of ice which, once formed is difficult to dislodge. If the hoses should freeze up then it may be necessary to remove the coolant from the tank and allow the ice block within the hoses to melt or alternatively to physically break up the ice. This inevitably leads to downtime for the snow making apparatus and is also time consuming and physically demanding for the operator.

It is therefore an object of the present invention to provide a snow making apparatus and/or a method of making snow or a snow substitute which addresses some of the aforementioned difficulties. An alternative object is to provide the public with a useful choice.

SUMMARY OF THE INVENTION

In accordance with a first aspect of the present invention, there is provided an apparatus for making snow or a snow-like substance including:

a container having a cooling space adapted to contain pressurized air or gas above atmospheric pressure; and at least one flexible walled vessel extending through the cooling space, the at least one vessel being connectable to a water source, wherein the apparatus is operable to maintain the cooling space at a sufficiently low temperature to at least partially freeze the water within the flexible walled vessel.

The apparatus may be adapted to maintain a static pressure within the cooling space of the container. In a more preferred form of the invention, a static pressure is maintained except that periodically and temporarily, the pressure within the container is increased to compress the flexible walled vessel.

Additionally, the apparatus may include a detachment aid to aid in detaching ice crystals and/or snow from the internal walls of the vessel. The detachment aid may comprise a mechanical device such as rollers to compress the at least one vessel. Alternatively, the detachment aid may comprise an inflation source to cyclically or intermittently at least partially inflate the at least one vessel to effect dislodgement of the snow and/or ice crystals from the inner walls of the vessel. Suitably, the vessel may include an air release valve to release the air from the vessel and permit deflation. While the use of pressurized air has been described, other gases may be substituted for air. The cyclic rate of inflation and deflation may be dependent upon the rate of generation of the snow and/or ice crystals within the at least one vessel.

The apparatus may be operable to pressurize the container above the static pressure coincident with the deflation of the at least one vessel. However, in a most preferred form of the invention, the pressure increase coincides with the deflation of the at least one vessel after every 10 to 15 cycles of inflation/deflation of the at least one vessel. This periodic increase of pressure provides greater effectiveness in breaking up the ice crystals within the vessel.

The static pressure may be approximately 20 kPa. The increased pressure may be approximately 25 to 30 kPa.

Another preferred feature of the invention is the inclusion of spray nozzles to spray a heat transfer medium onto the at least one vessel. The heat transfer medium may comprise a liquid such as brine or any other coolant. The heat transfer medium may be maintained at a low temperature through the use of refrigeration equipment. The apparatus may further include a heater to heat the heat transfer medium. Thus, periodically, the refrigeration equipment may be bypassed and instead the heat transfer medium circulated through the heater and the spray nozzles.

The flexible walled vessel may comprise a hose, pipe, tube, conduit or the like. However, the vessel is not restricted to being elongate in form and may comprise any shape appropriate for effective heat transfer. Preferably, the vessel is constituted of material(s) which are water impervious, inflatable and capable of remaining pliable at low temperatures. Preferably, the hoses have a smooth inner lining constituted of materials such as Teflon (trade mark), polyurethane, nylon or like plastics or rubber materials resistant to ice formation. The inner walls of the hoses may be coated with a non-stick coating such as linseed oil. Additionally, protective outer layers of the vessels may be provided. Such outer layers may comprise flexible material or fibres, including thin-walled polypropylene, plastic, fabric or metal fibres.

The at least one vessel may be provided with a discharge valve which operates in combination with the inflation source with the pressurized air/gas assisting in the flushing of snow and/or ice crystals through the vessel and out through the opening.

Suitably, there may be a plurality of vessels and the vessels may be held by the framework within the container. Further, the vessels may be grouped together so that all of the vessels within each group operate simultaneously during the freezing cycle and discharge simultaneously. The groups may be staggered in their phasing of the freezing cycle so that each group discharges successively, say a few minutes apart. The discharge valves of each group may be mechanically interconnected to operate in unison from a single actuator for the group.

The container may be in the form of a pressurizable tank or a pressure vessel. Preferably, the container has insulated walls.

While it has been indicated in the invention that the flexible walled vessels are connectable to a source of water, it will be understood that the term "water" may include mixtures of water with other ingredients such as mixtures of water with surfactants.

In accordance with a second aspect of the present invention, there is method a provided for making snow or a snow-like substance, comprising:

providing a container having a cooling space containing a fluid comprising substantially air with at least one flexible walled vessel extending through the cooling space;

connecting the at least one flexible walled vessel to a source of fluid comprising substantially water;

pressurizing the cooling space within the container to a pressure above atmospheric pressure; and maintaining the cooling space at a sufficiently low temperature to at least partially freeze the fluid within the flexible walled vessel.

Any of the features described above in connection with the first aspect of the invention may be implemented in the method of the second aspect.

In accordance with a third aspect of the present invention there is provided an apparatus for making snow or a snow-like substance including:

at least one flexible walled vessel connectable to a water source;

spray equipment to spray heat transfer medium onto the at least one flexible walled vessel to chill the at least one flexible walled vessel sufficient to form ice crystals and/or snow within the at least one vessel.

In accordance with the fourth aspect of the present invention there is provided a method for making snow or a snow-like substance comprising:

providing at least one flexible walled vessel; and connecting the at least one flexible walled vessel to a source of fluid comprising substantially water;

spraying heat transfer medium onto the flexible walled vessel to form ice crystals and/or snow within the vessel.

The method may also include manipulating the vessel to detach ice crystals from the inner wall of the vessel. The manipulation may be provided by inflating the flexible walled vessel by a source of pressurized gas applied internally to the vessel. The gas, which may be air may be permitted to bleed from the vessel to allow deflation. Furthermore, the flexible walled vessel may be subjected to external pressurization, for example, by being held within a pressure vessel, to assist in compressing the flexible walled vessel.

As mentioned above, the flexible walled vessel may be housed within a container such as a pressure vessel. The container may include a catchment for the heat transfer medium to enable reuse. The method may also comprise discharging the snow or snow-like substance from within the vessel out through an opening. Any of the features described above in connection with the first aspect of the invention may be applied to the third and fourth aspects of the invention.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

BRIEF DESCRIPTION OF THE DRAWINGS

In order that the invention may be more fully understood, one embodiment will now be described by way of example with reference to the following Figures.

PREFERRED EMBODIMENT

Figure 1:
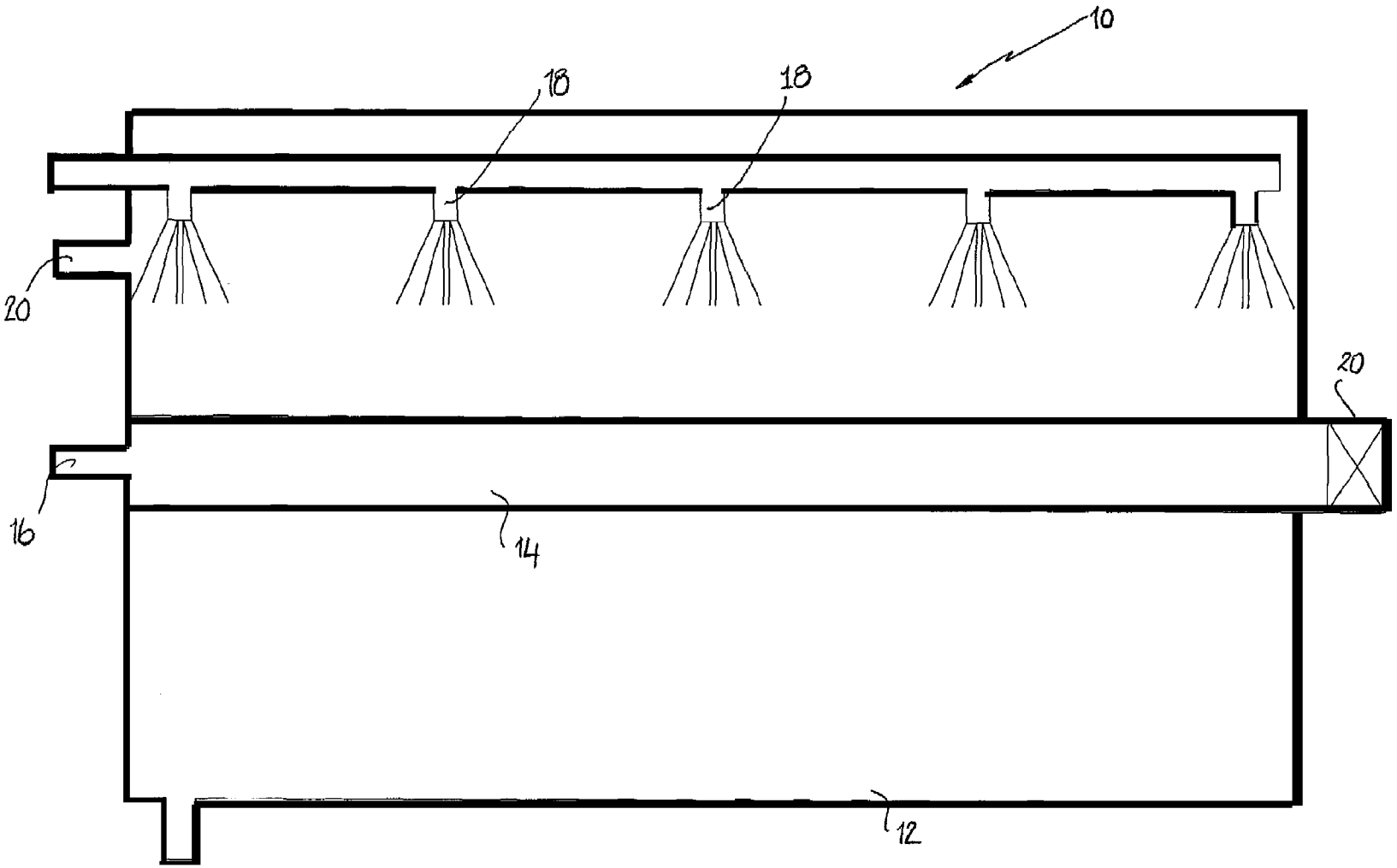
FIG. 1 is a schematic view of a snowmaking apparatus in accordance with a preferred embodiment of the present invention.

FIG. 1 show schematically, the operation of a snow making apparatus 10 according to the present invention. The snow-making apparatus comprises a container such as pressure vessel or tank 12 which defines a cooling space 13. Extending through the cooling space are a number of flexible walled vessels such as hoses 14 of which only one is shown in the figure. The hoses 14 are connected to a water source as well as a source of pressurised air through inlet 16.

The pressure vessel 12 also includes a plurality of spray nozzles 18 which operate to spray a heat transfer medium eg. coolant such as glycol onto the hoses 14. Additionally, the cooling space 13 is pressurised to about 20 kPa above atmospheric pressure through the pressurising gas inlet 20. The conditions within the pressure vessel 12 are such that water within the hoses 14 is caused to freeze or to form snow and/or ice crystals on the internal walls of the hoses through the process of heat transfer through the walls of the hose. The flexible hoses are cyclically inflated and deflated to assist with the removal of the snow and/or ice crystals from the walls of the hoses.

The end of each hose opposite the water and air inlet is provided with a discharge valve 20. The discharge valve 20 allows the pressurised air to bleed from the hose to permit deflation of the hose 14 during the cycle of inflation and deflation. As mentioned above, the cooling space is generally maintained at a static pressure of 20 kPa above atmospheric pressure during the cyclic inflation and deflation. However, every 10-15 cycles of inflation and deflation, the pressure is temporarily increased to approximately 25 to 30 kPa above atmospheric pressure, coincident with the deflation of the flexible hoses 14. This increased pressure serves to break up any ice which has formed into blocks within the hoses 14. Once the process has continued for a time sufficient to cause most of the water within the hoses to form snow or ice crystals, the discharge valve 20 is fully opened and pressurised air through inlet 16 assists with evacuating the snow and/or ice crystals from the hoses 14.

Figure 2:
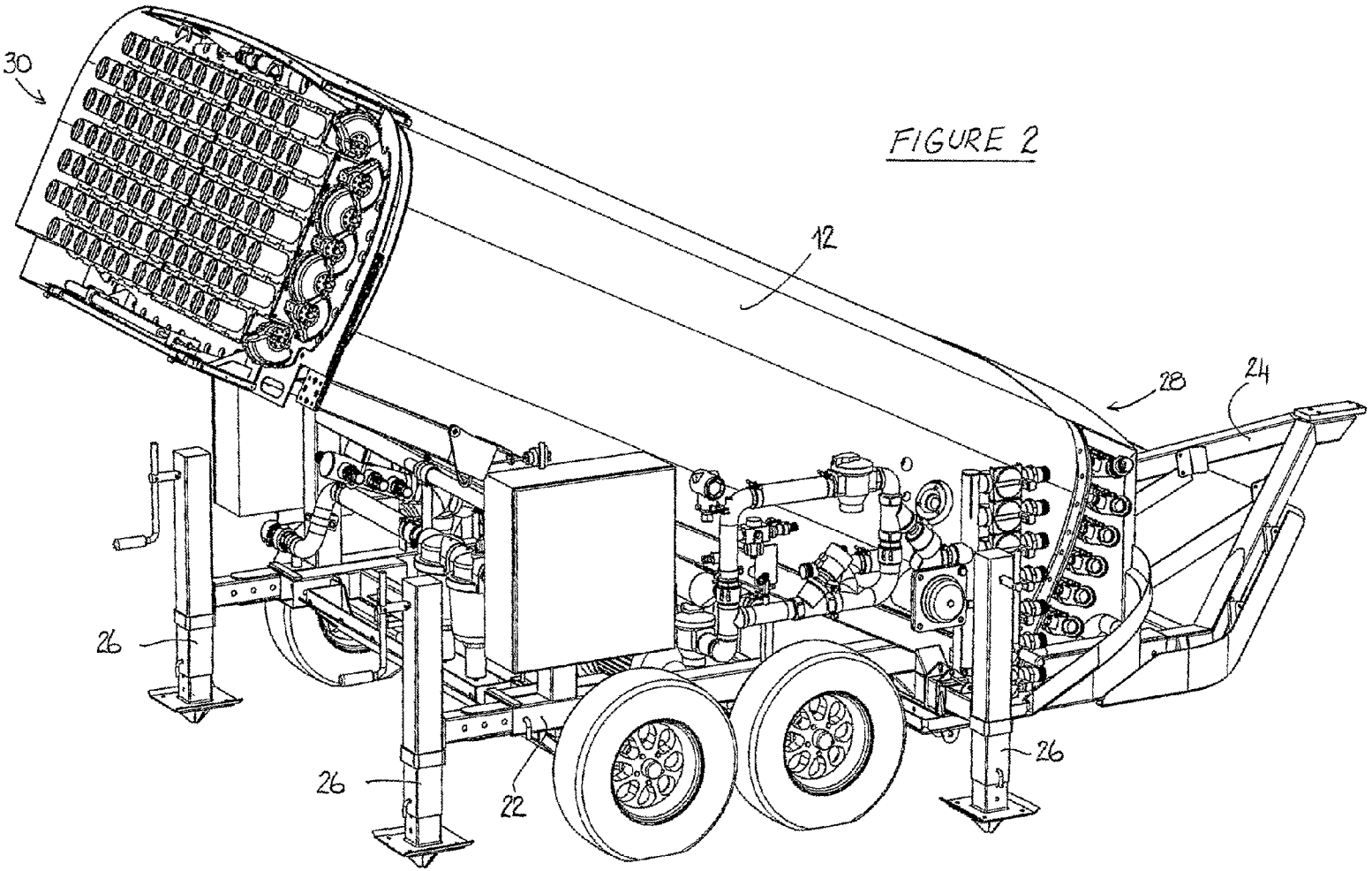
FIG. 2 is a perspective view of a snow making apparatus according to a preferred embodiment of the present invention.

FIG. 2 is a perspective view of the entire snow making apparatus 10 including the pressurisable tank 12. The apparatus 10 is portable in that the tank 12 is mounted on a wheeled chassis 22 provided with a draw bar 24 and ground engaging props 26. During transit, the ground engaging props move to a non-ground engaging configuration so that the wheeled chassis 22 may be towed by means of the draw bar 24.

The snow making apparatus 10 shown in FIG. 2 has two ends including a lower inlet end 28 and an upper discharge end 30. By means of various pipe work, water and air are inlet into the tank 12 through the inlet end 28. Snow or snow like particles are discharged through the discharge end 30 in a manner which will be explained.

Figure 3:
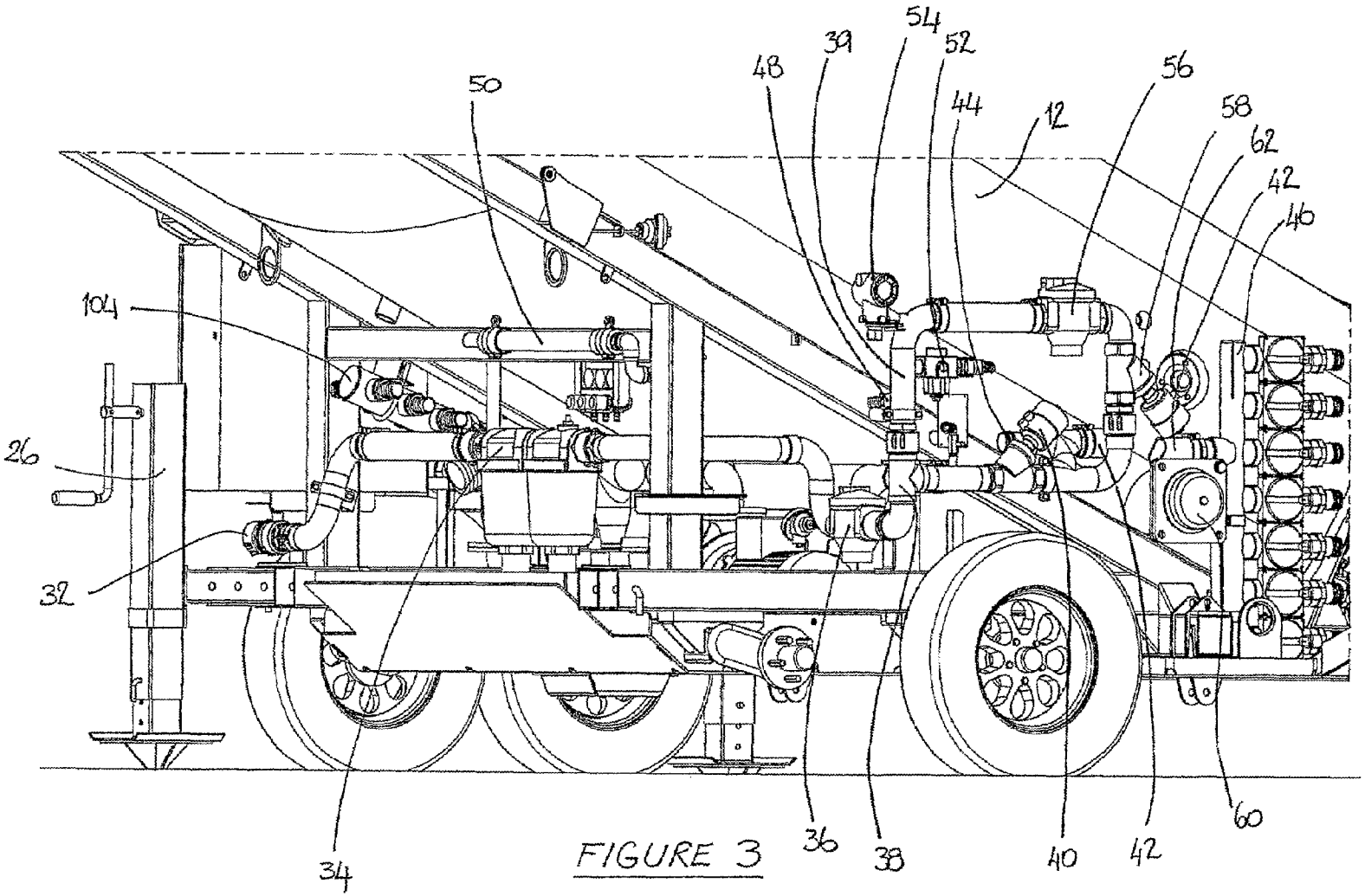
FIG. 3 is a detailed perspective view showing the underside of the apparatus of FIG. 2.

FIG. 3 shows the pipe work for the air supply in greater details. An air supply connection 32 is provided for connection to an air source such as a compressor (not shown). The air then passes through an air filter 34 for oil and water removal. Following on from the air filter 34, the air passes to a high pressure air regulator 36. This regulates the air pressure down to a pressure of approximately 7 bar. For example, the air supply may have been provided at a pressure of 8 bar. From there, the air passes into a vertical leg where it meets a T junction 38. To the right of the T junction 38, the air passes to a high pressure air control valve 40. Beyond the valve 40, another junction splits the supply line into a proximate supply line 42 and a distal supply line 44. The proximate supply line 42 is shown in broken configuration for clarity but feeds into the vertical air distribution manifold 46 provided for the proximate side of the machine. In this sense, "proximate" is to be understood from the viewpoint of FIG. 3. The distal supply line 44 extends around to the other side of the apparatus to supply a vertical air distribution manifold (not shown) for the distal side of the apparatus. The distal supply line 44 is not shown for clarity purposes.

Returning to the T junction 38, taking the vertically upward branch line 39, the first branch is a connection 48 for a hose tail. This hose tail goes to the instrument air dryer 50. The air from the instrument air dry then passes to various control valves and instrumentation. The instrument air dryer 50 is required to prevent icing of the instruments and valves.

Returning to the branch line 39 a tank pressurisation regulator 52 is provided. The tank pressurisation regulator controls the tank pressure while solenoid valves (not shown) turn on and off the pressure into the tank as required. Above the tank pressurisation regulator 52 is provided a tank pressurisation measuring instrument 54 (which is not connected to the branch line). This tank pressurisation measuring instrument 54 communicates with the space within the tank 12 to measure the tank pressure. This reading feeds back to a controller (not shown) which in turn controls the tank pressurisation regulator 52 and solenoids to maintain the pressure within the tank 12 at a desired pressure.

Continuing along the branch line 39, is a low pressure air regulator 56 followed by a low pressure air control valve 58. Beyond that, the branch line feeds into the junction where the air supply line separates into the proximate supply line 42 and the distal supply line 44.

As has already been explained in connection with the schematic of FIG. 1, the interior of the flexible hoses are cyclically inflated and deflated to manipulate the hoses to assist with the removal of snow and/or ice crystals from the walls of the hoses. This is achieved with a low pressure input into the hoses. Thus, the low pressure air regulator 56 is provided to step down the air pressure to the required air pressure for manipulation while the low pressure air control valve 58 effects the switching on and off of the low pressure air supply.

As also explained above, pressurised air also assists evacuating the snow and/or ice crystals from the hose 14. This is achieved with the high pressure air supply which is regulated by means of the high pressure air regulator 36 with the switching on and off controlled by the high pressure air control valve 40. The controller determines the operation of the valves and regulators 56, 58, 36 and 40 according to a pre-programmed sequence and/or with feedback from the various instruments.

Also illustrated in FIG. 3 are a number of other features associated with the tank 12. A pressure release valve 60 is provide to avoid excessive pressure within the tank 12. Additionally, a vacuum break 62 prevents a vacuum during start up and emptying of the tank 12. Within the spaces enclosed by the circular branch line 39 is a heater (not shown) which keeps warm the various valves and regulators within that zone.

Figure 4:
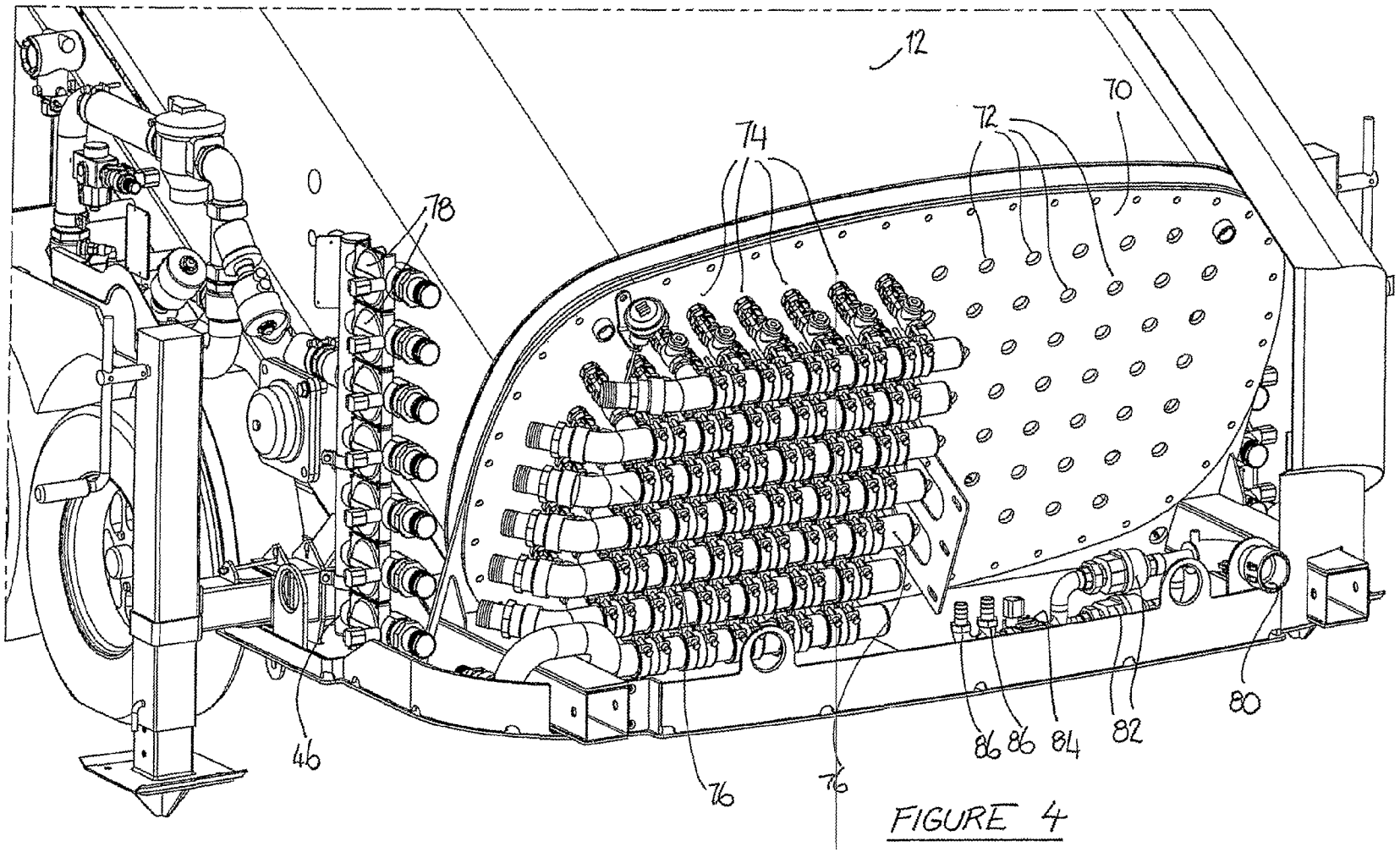
FIG. 4 is a detailed perspective view showing the inlet end of the apparatus of FIG. 2.

Reference is now made to FIG. 4 which shows the inlet end 28 of the apparatus in greater details. At the inlet end 28, the tank 12 is provided with an end plate 70 having a plurality of inlet points 72. Each of the inlet points 72 is connected to a hose 14 within the tank 12 and each inlet point provides for the inlet of air and water through air and water inlet portals 74. As can be seen, one portal 74 is provided for each inlet point 72. As will be appreciated, FIG. 4 is shown only with the portals 74 on the proximate side of the tank 12. The portals on the distal side of the tank are not shown for clarity purposes. Each of the portals 74 are grouped into horizontal rows and are connected to a common horizontal air manifold 76. Each horizontal air manifold 76 on the proximate side of the machine connect to the proximate vertical air manifold 46 while the horizontal air manifolds (not shown) on the distal side of the machine connect to the distal vertical air manifold. Each of the horizontal air manifolds is connected to a respective manifold valve 78. The manifold valves 78 are controlled by the controller which determines which of the manifold valves 78 is open and thus which horizontal air manifold is supplied with pressurised air and accordingly, which group of hoses is supplied with pressurised air. This is because the filling and discharge of each of the groups of hoses 14 is phased relative to one another so that the groups of hoses discharge one at a time in succession. Otherwise, each of the hoses within one group operate simultaneously.

Figure 6:
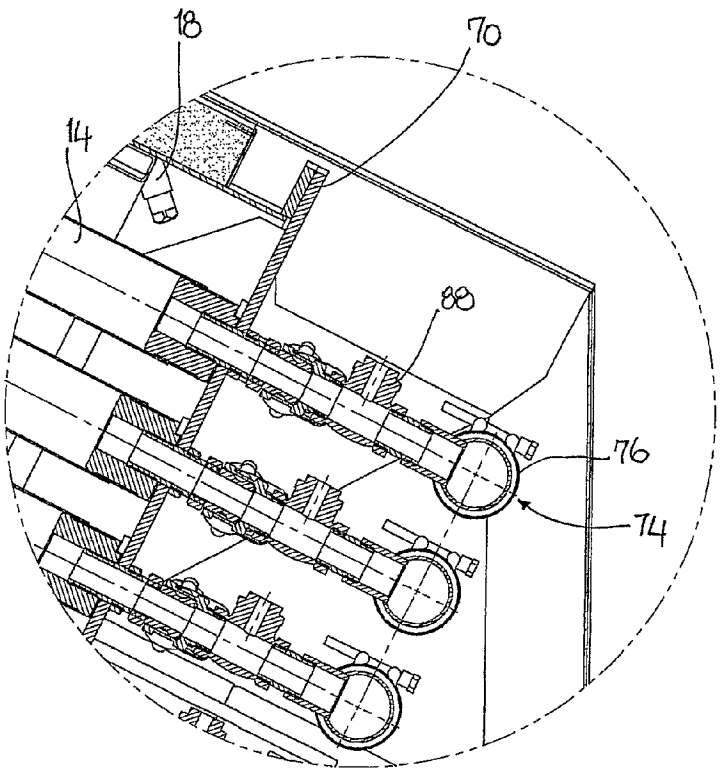
FIG. 6 is a detailed cross sectional view of A of FIG. 5.

FIG. 6 shows in greater detail the portal 74 and the horizontal air manifold 76 through which air is passed into a respective hose 14.

Reverting to FIG. 4, a water inlet 80 is provided. The water line branches into two parallel water meters 82, through a solenoid valve 84 to hose tails 86. The hose tails 86 connect to respective water distribution manifolds, one provided for each side of the apparatus. The water distribution manifolds then divide the water into hosings (not shown) which connect to each portal 74 through the check valve 88 shown in FIG. 6. Each of the hosings are grouped from the water distribution manifold so that water is provided simultaneously into each of the portals 74 of a group. The check valve 88 prevents water from running back into the air supply.

Although it is not shown in the figures, the inlet end 28 of the tank 12 is provided within a protective cover to form an enclosed space at the inlet end 28. A heater (not shown) is provided within the enclosed space to prevent icing.

Figure 5:
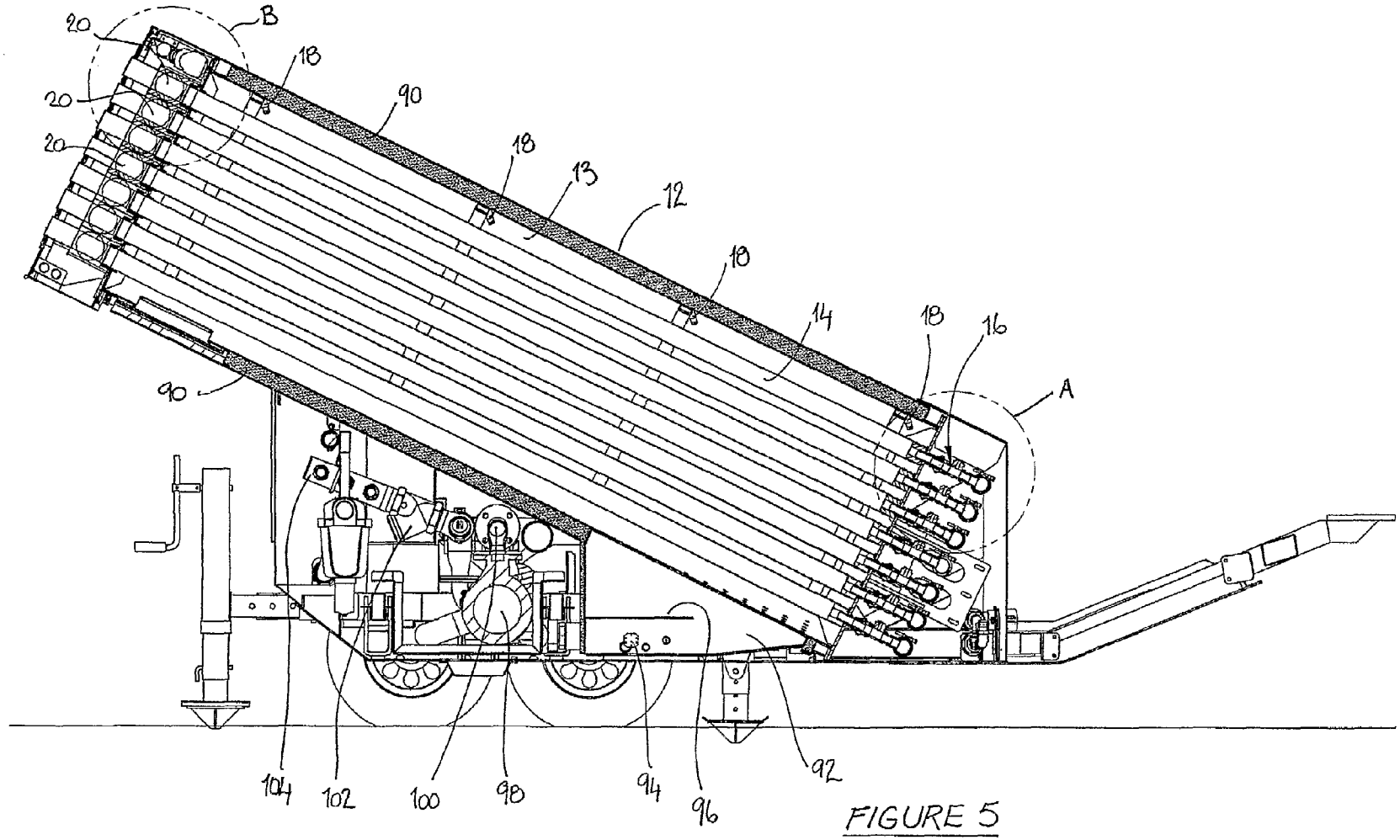
FIG. 5 is a side view, partly in section of the snow making apparatus of FIG. 2.

Turning to FIG. 5, as already mentioned, there are a number of hoses 14 provided within the cooling space 13 of the tank 12. The tank 12 is insulated with insulative cladding 90. By means of the tank pressurisation regulator 52 and associated valves, the interior of the tank 12 is maintained a static pressure of approximately 20 kPs above atmospheric pressure. A heat transfer medium such as glycol is sprayed onto the hoses 14 to freeze the water within the hoses. In particular, ice crystals form on the inner surface of the walls of the hoses 14. The hoses are manipulated to remove the ice crystals from the inner surface of the wall of the hoses and to assist in creating a snow-like product of individual crystals rather than solid block of ice. This manipulation is achieved by the inlet of air through the portals 74 by means of the low pressure air regulator 56 and the low pressure air control valve 58. As already mentioned, a discharge valve 20 is provided at the other end of each hose. The discharge valve 20 which open cyclically after inflation of the hoses enables the bleed of air from within the hoses 14, while the above atmospheric pressure within the tank 12 assists with the deflation of the hoses. This cycle of inflation and deflation of the hoses 14 continues until substantially all of the water within the hoses has been converted to snow or snow-like particles. As already mentioned, the inlet of water and air into each of the hoses is phased so that the groups of hoses will fill sequentially with all of the hoses within one group filling at the time. The hoses will also discharge sequentially with all of the hoses in one group discharging at the same time. However, the cyclic inflation and deflation of all the hoses may be synchronised.

Periodically, say every 10 to 15 cycles of inflation and deflation, the pressure within the tank 12 will increase to say 25-30 kPa above atmospheric pressure. This coincides with deflation of all of the hoses 14. Thus the increased tank pressure created an additional force to break up any ice within the hoses 14 which has formed into blocks.

The heat transfer medium which is sprayed onto the hoses 14 through spray nozzles 18 is circulated through the apparatus. See FIG. 5 in connection with the fluid circuit diagrams of FIG. 11. The heat transfer medium is initially collected in a sump 92 which is provided with various instrumentation including temperature, sump level and sump fill meters. A heater 94 is also provide within the sump 92 but only used periodically as will be explained. A cavitation plate 96 is also provided within the sump.

From the sump, the heat transfer medium passes through a manual shut off valve 97 which is connected to pump 98 by means of a flexible connector 99. The coolant pump 98 is then connected to a flexible connector 101, through a T junction 103 to a main control valve 105. Beyond the main control valve 105, the heat transfer fluid passes to the chiller (not shown). After the chiller, the heat transfer medium returns and passes through T junction 115, adjacent which is provided a temperature sensor 107. A strainer 102 is also provided from where the heat transfer fluid passes through to the distribution manifold 104. The distribution manifold 104 can also be viewed in FIG. 3. The distribution manifold has a number of outlets which connect to 4 spray conduits, each of which extend transversely across the interior of the tank. The spray conduits feed the spray nozzles 18. During normal operation, the heat transfer medium is collected by the sump 92 and is circulated by the pump 98 through the chiller and back into the spray nozzles 18.

Figure 11:
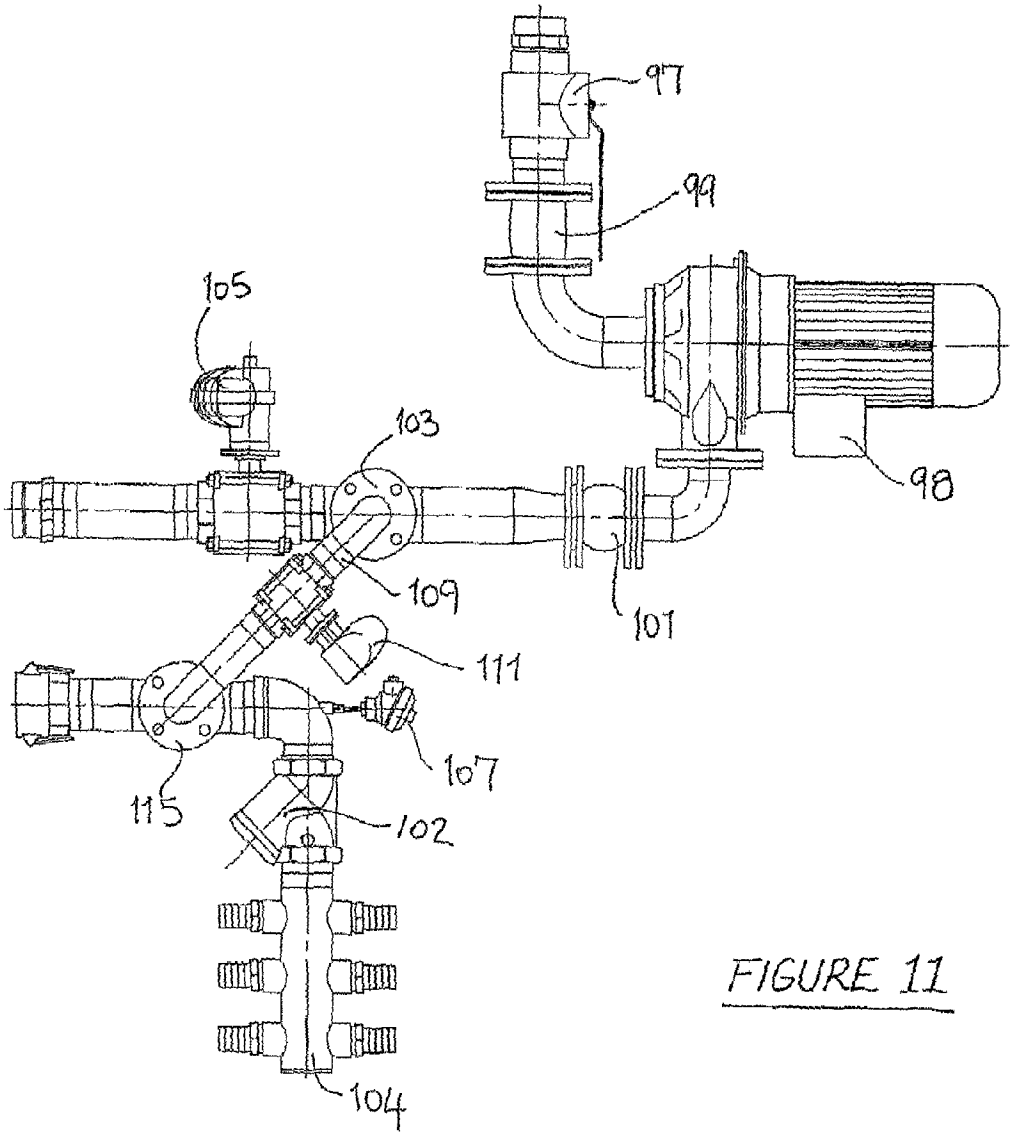
FIG. 11 is a schematic fluid circuit diagram.

In FIG. 11, it can be seen that the two T junctions 103, 105 are interconnected by a bypass conduit 109 provided with a bypass control valve 111. Periodically, the chiller is bypassed by shutting off the main control valve 105 and opening the bypass control valve 111 so that the heat transfer medium can pass through the bypass conduit 109. When this occurs, the heater within the sump is switch on. As a result, the heat transfer medium is heated and this passes through to the spray nozzles and on to the hoses to prevent icing within the hoses 14.

While the apparatus 10 shown has its own dedicated chiller, in another embodiment, a number of like apparatus 10 may be connected to common chiller.

Figure 7:
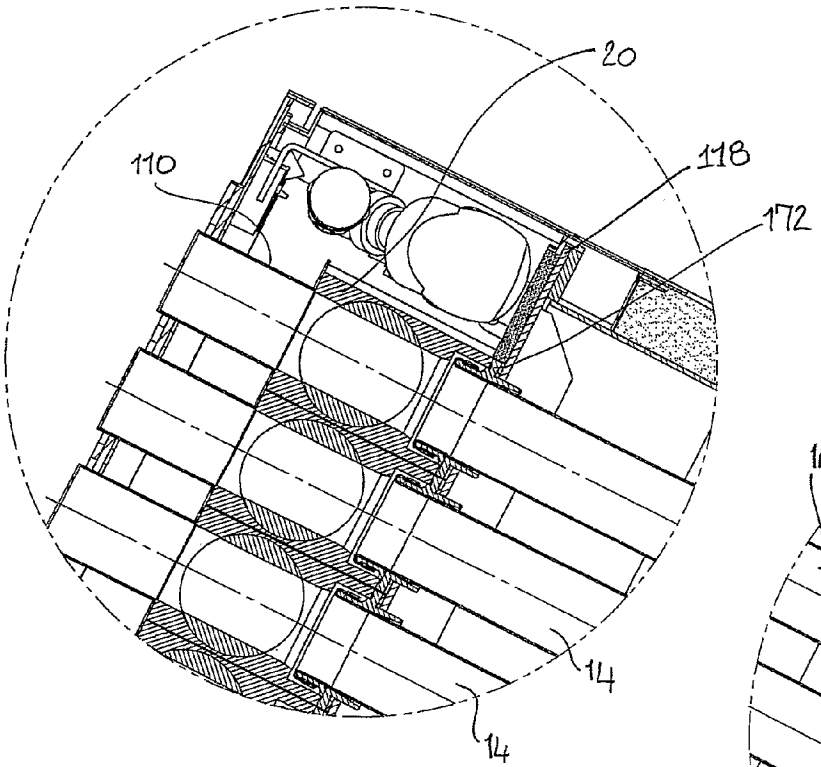
FIG. 7 is a detailed cross sectional view of B of FIG. 5.

FIG. 7 shows in greater details the end of the hoses 14 at the discharge end 30 of the apparatus. The hoses 14 are each connected to a respective discharge valve 20. At the exit of each discharge valve 20 is provided a safety tube 110.

Figure 8:
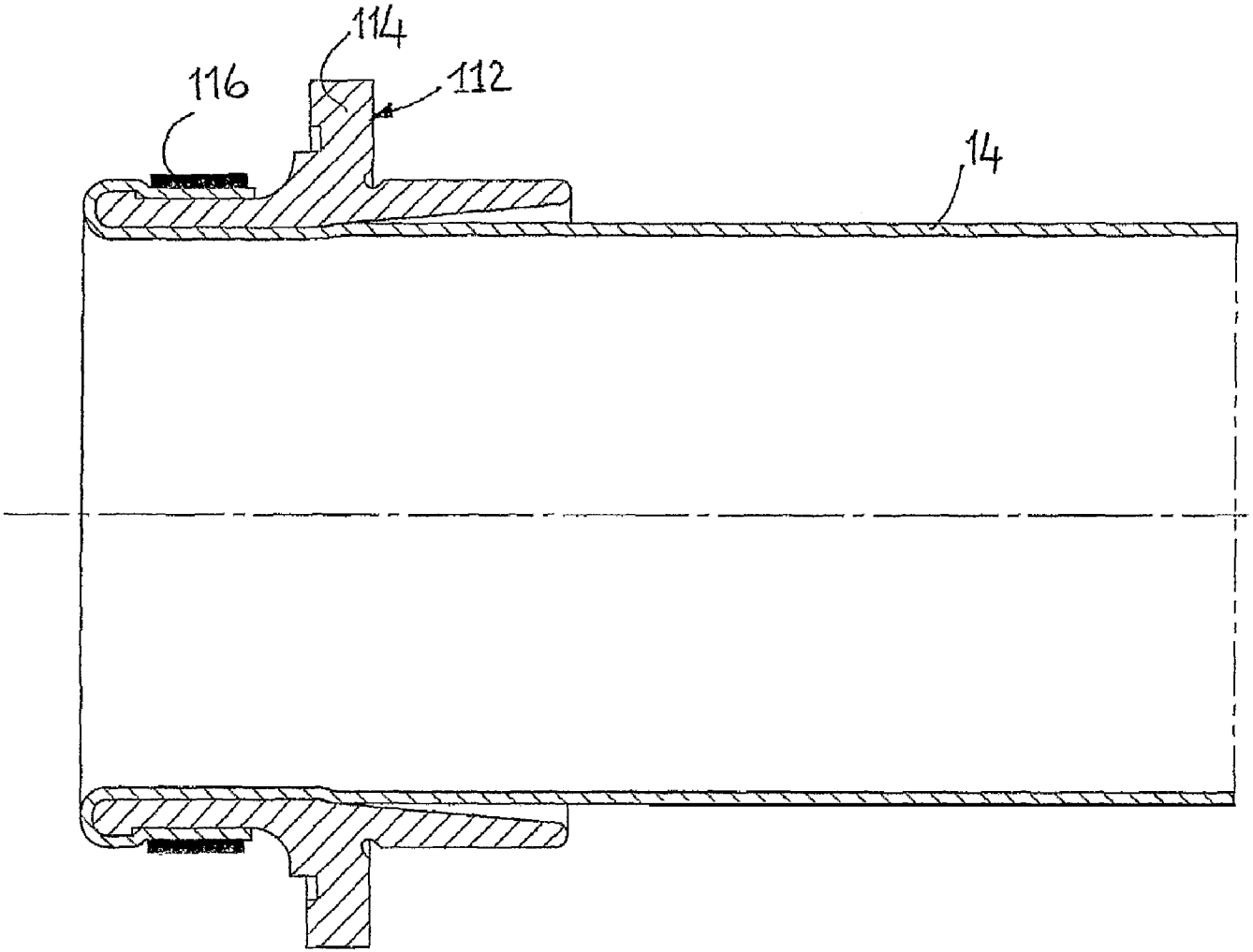
FIG. 8 is a cross sectional view illustrating the discharge end of one hose of the snow making apparatus of FIG. 2.

FIG. 8 shows more clearly the termination of each hose 14 at the discharge end 30. Each hose 14 is fitted with a hose end fitting 112 having a peripheral flange 114. The hose 14 is folded over the outer end of the hose end fitting 112 and an annular clamp 116 secures the end of the hose 14. Similar to the end plate 70 provided at the inlet end 28 of the apparatus, the discharge end is also provided with an end plate 118. The hose end fittings 112 are received within apertures of the end plate 118 with gasket seal provided therebetween.

Figure 9:
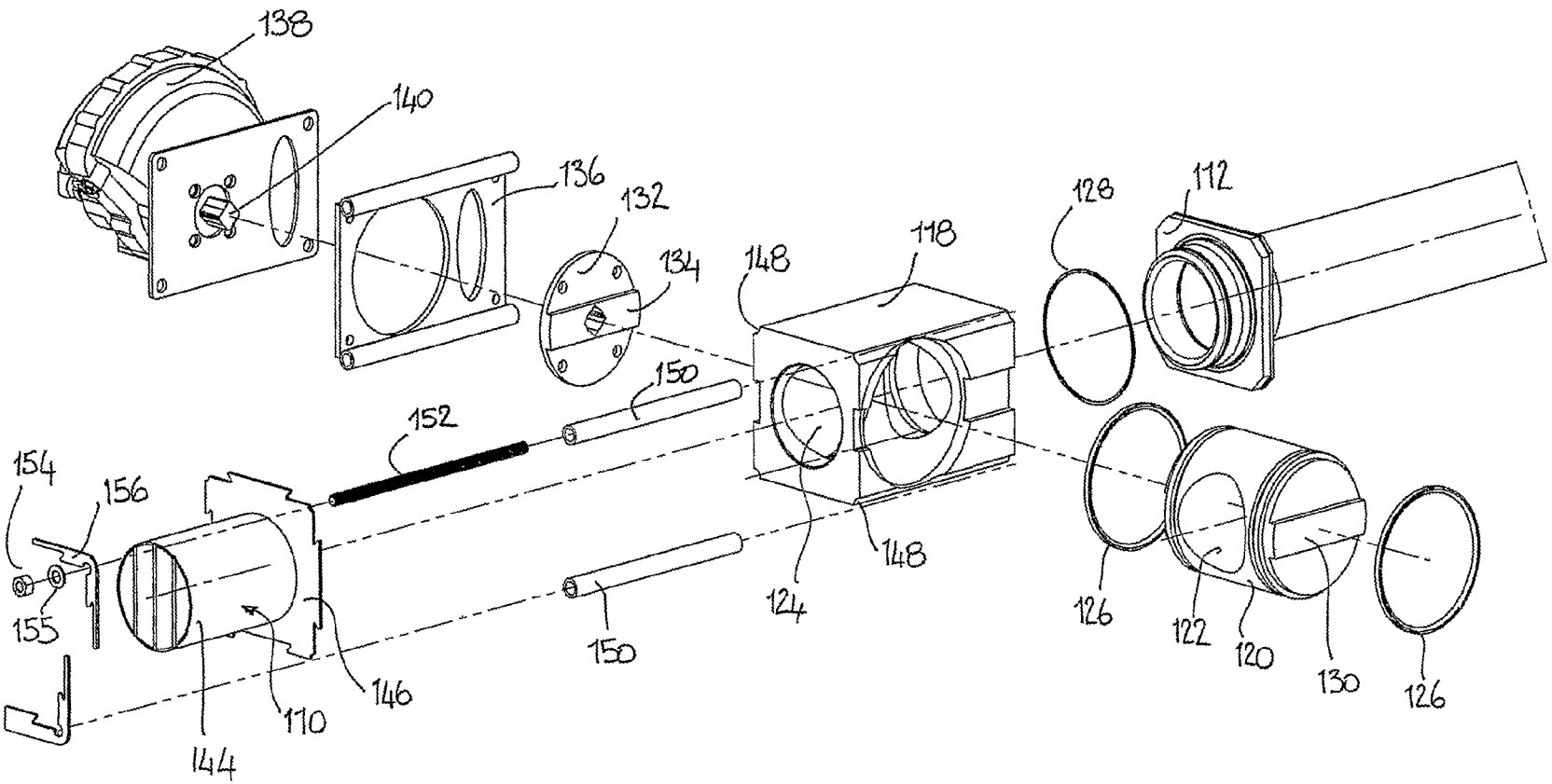
FIG. 9 is an exploded perspective view of a discharge valve forming part of the snow making apparatus of FIG. 2.

FIG. 9 which is an exploded perspective view of the discharge valve 20 also shows in perspective, the form of the hose end fitting 112. The discharge valve 20 comprises a plastic housing 118 in which is received a rotary valve element 120. The valve element 120 has an aperture 122 therethrough. Likewise, the housing 118 has an aperture 124 therethrough. When the aperture 122 is aligned with the aperture 124 then the valve is open. Rotary seals 126 are seated in the housing 118 on each side of the rotary valve element 120. An O ring 128 is provided between the housing 118 and the hose end fitting 112.

As can be seen in FIG. 9, one side of the rotary valve element 120 is provided with a tenon 130. The other side of the rotary valve element 120 which is not shown is provided with a mortice, for reasons which will be explained hereafter. The rotary valve element 120 is connected to a drive plate 132 which has tenon 134 provided thereon. The drive plate 132 is received within a circular cut out of a valve cover 136. The drive plate 132 is driven by the valve drive acutator 138. The valve drive actuator 138 has a spindle 140 which rotates the drive plate 132 having tenon 134 which cooperates with the mortice of the rotary valve element to thereby rotate the rotary valve element 120.

Figure 10:
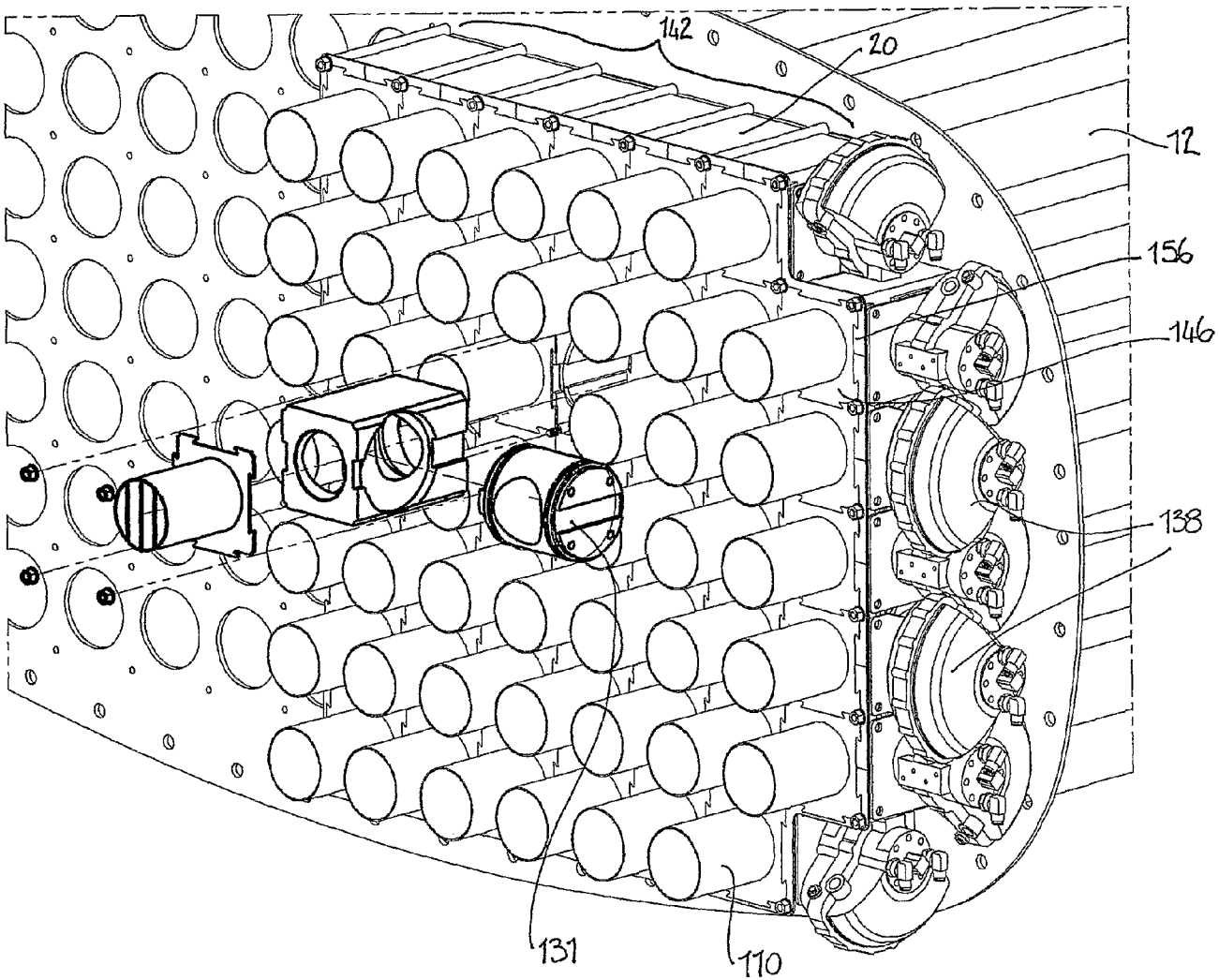
FIG. 10 is a perspective view, partly in exploded form illustrating the discharge end of the snow making apparatus of FIG. 2.

The discharge valves 20 are grouped by rows into groups of 6 or 7 as shown in FIG. 10. For example, see group 142 of 6 rotary valves 20. Only one valve drive actuator 138 is provided for each row of valves 20. Each of the valves 20 are mechanically interconnected by means of the tenon 130 being received in the mortice 131 (see FIG. 10) of the adjacent rotary valve element. Thus all of the rotary valve elements 120 for each group 142 rotate in unison. The valve cover 136 is provided at the ends of each group 142. Across each aperture 124 provided in the housing 118 is provided a safety tube 110 which is in the form of a metal cylindrical tube 144 and flange plate 146. The flange plate 146 is mounted against the outer end of the housing 118. As will be appreciated from FIG. 10, the flange plate 146 has a jigsaw shape which enables the flange plates 146 to be interconnected with adjacent flange plates.

It can be also seen from FIG. 9 that the housing 118 has radiused corners. When all of the housings 118 are mounted together the radiused corners of adjacent housings 118 cooperate to form cylindrical bores in which are received spacer tubes 150. The spacer tubes receive an elongate stud 152 which has one end received into the end plate 118. A nut 154 and washer 155 secures against the flange plate 146 to thereby hold the safety tube and the discharge valve 20 in position on the end plate 118. This arrangement reduces the number of fasteners required since essentially one stud can be provided for each safety tube and discharge valve combination. As shown in FIGS. 9 and 10, edge pieces 156 are of a complementary shape to the flange plates 146 and finish the outer edges of the flange plates 146.

Although not shown, the discharge end 30 of the apparatus may also be provided with a cover and a heater may be provided therein to avoid ice build up around the safety tubes 110, discharge valves 20 and drive actuator 138. The heating within the discharge end cover may be provided by means of self regulating heating tape winding about the safety tubes and drive actuators 138

It would be appreciated that when snow is being discharged through the safety tubes 110, the particular group of metal safety tubes 110 will undergo a degree of contraction as the cold snow passes therethrough. They will later expand after this step. This contraction and expansion of the safety tubes 110 is relative to the underlying discharge valves 20 which are mainly comprised of plastic and therefore do not undergo the same degree of contraction and expansion. Thus the arrangement of the jigsaw shaped flange plates and their floating connection to the end plate 118 accommodate the differential expansion and contraction of each group.

Additionally, a hood may be provided at the discharge end of the apparatus which is generally clear of the discharge end. However, the hood is provided to drop down over the discharge end during the defrost cycle to deflect any ice which is ejected during the defrost cycle. However, the hood is not a preferred feature and instead an appropriate defrost regime implemented through the use of the heater 94 within the sump 92 is to be implemented. The frequency of the defrost step is conducted at intervals dependent upon the rate of icing.

The foregoing describes only one embodiment of the present invention and modifications may be made thereto without departing from the scope of the present invention as defined in the claims.

The invention claimed is:

1. An apparatus for making snow or a snow-like substance comprising:

a pressure vessel having a cooling space adapted to contain pressurized air or gas of above atmospheric pressure; and at least one flexible walled vessel extending through the cooling space, the at least one flexible walled vessel being connectable to a water source, wherein the apparatus is operable to maintain the cooling space at a sufficiently low temperature to at least partially freeze the water within the flexible walled vessel.

2. The apparatus as claimed in claim 1 which is adapted to maintain a static pressure within the cooling space of the pressure vessel.

3. The apparatus as claimed in claim 1 which is adapted to maintain a static pressure within the cooling space of the pressure vessel and to periodically and temporarily increase the pressure within the cooling space externally of the at least one flexible walled vessel to compress the at least one flexible walled vessel.

4. The apparatus as claimed in claim 3 further comprising a detachment aid to aid in detaching ice crystals and/or snow from the internal walls of the at least one flexible walled vessel, the detachment aid comprising an inflation source to cyclically or intermittently at least partially inflate the at least one flexible walled vessel to effect dislodgement of the snow and/or ice crystals from the internal walls.

5. The apparatus as claimed in claim 4 wherein the inflation source also serves to discharge the ice crystals and/or snow from within the at least one flexible walled vessel.

6. The apparatus as claimed in claim 4, operable to temporarily increase the pressure in the cooling space of the pressure vessel above the static pressure, at the frequency of between 10 and 15 inflation/deflation cycles of the at least one flexible walled vessel.

7. The apparatus as claimed in claim 1 further comprising spray nozzles to spray a heat transfer medium onto the at least one flexible walled vessel.

8. The apparatus as claimed in claim 7 further comprising refrigeration equipment to chill the heat transfer medium, wherein the apparatus operates to circulate the heat transfer medium through the spray nozzles and the refrigeration equipment.

9. The apparatus as claimed in claim 8 wherein the at least one flexible walled vessel comprises a hose, pipe, tube or conduit, and the apparatus further includes a heater to heat the heat transfer medium, wherein the apparatus is operable to periodically bypass the refrigeration equipment and instead circulate the heat transfer medium through the heater and the spray nozzles.

10. The apparatus as claimed in claim 5 wherein there are a plurality of flexible walled vessels arranged in groups and wherein each of the flexible walled vessels has a discharge valve and the discharge valves of each group are mechanically interconnected to operate in unison, with each group having their flexible walled vessels discharged at successive intervals.

11. The apparatus as claimed in claim 7 further comprising a detachment aid to aid in detaching ice crystals and/or snow from the internal walls of the at least one flexible walled vessel wherein the detachment aid comprises an inflation source to cyclically or intermittently at least partially inflate the at least one flexible walled vessel to effect dislodgement of the snow and/or ice crystals from the internal walls thereof and wherein the at least one flexible walled vessel includes an air release valve to release the air therefrom and permit deflation thereof.

12. The apparatus as claimed in claim 11 wherein the inflation source also serves to discharge the ice crystals and/or snow from within the vessel.

13. The apparatus as claimed in claim 1, wherein during operation of the apparatus, the cooling space of the pressure vessel contains pressurized air or gas of above atmospheric pressure.

14. The apparatus as claimed in claim 1, further comprising an air source coupled with the pressure vessel for delivering a pressurized gas to the pressure vessel.

15. A method for making snow or a snow-like substance, comprising:

providing a container having a cooling space containing a fluid comprising substantially air with at least one flexible walled vessel extending through the cooling space;

connecting the at least one flexible walled vessel to a source of fluid comprising substantially water;

pressurising the cooling space within the container externally of the at least one flexible walled vessel to a pressure above atmospheric; and maintaining the cooling space to a sufficiently low temperature to at least partially freeze the fluid within the flexible walled vessel.

16. The method as claimed in claim 15 further comprising periodically and temporarily increasing the pressure within the container to compress the at least one flexible walled vessel.

17. The method as claimed in claim 15, further comprising maintaining a static pressure within the cooling space of the container and periodically and temporarily increasing the pressure within the cooling space to compress the at least one flexible walled vessel.

18. The method as claimed in claim 15 further comprising cyclically or intermittently at least partially inflating the at least one flexible walled vessel to effect dislodgement of the snow and/or ice crystals from the internal walls of the vessel.

19. The method as claimed in claim 15 further comprising spraying a chilled heat transfer medium onto the at least one flexible walled vessel.

20. The method as claimed in claim 19 further comprising periodically heating the heat transfer medium and spraying the heat transfer medium onto the at least one flexible walled vessel.

21. The method as claimed in claim 19 further comprising manipulating the at least one flexible walled vessel to detach ice crystals and/or snow from the internal wall thereof, wherein the manipulation is provided by cyclically or intermittently at least partially inflating the at least one flexible walled vessel by a source of pressurized air or gas applied internally thereto, wherein the air or gas is permitted to bleed therefrom to allow deflation.

* * * * *